US006112484A

United States Patent [19]

Brasington

[11] Patent Number: 6,112,484

[45] Date of Patent: Sep. 5, 2000

[54] STRUCTURAL MEMBER WITH STRENGTH-REINFORCING STEEL STRAP

[76] Inventor: Millard A. Brasington, 182 Freeze Crossing Dr., Mooresville, N.C. 28115

[21] Appl. No.: 09/173,877

[22] Filed: Oct. 16, 1998

[51] Int. Cl.[7] ..... E04C 2/34; E04C 3/10; B21D 47/01

[52] U.S. Cl. ..... 52/223.6; 52/223.12; 29/897.32; 29/897.35

[58] Field of Search ..... 52/223.6, 223.8, 52/223.12, 650.3, 654.1, 647; 29/897.312, 897.3, 897.31, 897.32, 897.35

[56] References Cited

U.S. PATENT DOCUMENTS

| | | | |
|---|---|---|---|
| 1,770,932 | 7/1930 | Leake | 52/223.12 |
| 2,039,398 | 5/1936 | Dye | 52/223.12 |
| 2,510,958 | 6/1950 | Coff . | |
| 2,822,068 | 2/1958 | Hendrix . | |
| 3,294,608 | 12/1966 | Peterson | 52/223.8 |
| 3,398,498 | 8/1968 | Krauss . | |
| 3,427,773 | 2/1969 | Kandall . | |
| 4,006,523 | 2/1977 | Mauquoy . | |
| 4,015,376 | 4/1977 | Gerhardt . | |
| 4,236,362 | 12/1980 | Omholt . | |
| 4,275,537 | 6/1981 | Pinson . | |
| 4,353,190 | 10/1982 | Gleeson . | |
| 4,409,764 | 10/1983 | Wilnau . | |
| 4,561,227 | 12/1985 | Austin . | |
| 4,607,470 | 8/1986 | Ecker . | |
| 4,704,830 | 11/1987 | Magadini . | |
| 5,048,257 | 9/1991 | Luedtke . | |
| 5,134,821 | 8/1992 | Sadahiro . | |
| 5,467,570 | 11/1995 | Leek . | |

*Primary Examiner*—Michael Safavi
*Attorney, Agent, or Firm*—Adams, Schwartz & Evans, P.A.

[57] ABSTRACT

A load-bearing structural member includes an elongate beam and a strength-reinforcing flat steel strap. The beam has a top and a bottom, and first and second opposing ends. The steel strap extends along the length of the beam from one end to the other, and is adapted for transferring an intermediate load acting on the beam outwardly to the opposing ends of the beam. Anchor plates located at respective opposing ends of the beam engage and hold the strap in tension.

19 Claims, 10 Drawing Sheets

STRUCTURAL MEMBER WITH STRENGTH-REINFORCING STEEL STRAP

TECHNICAL FIELD AND BACKGROUND OF THE INVENTION

This invention relates to a load-bearing structural member. The structural member includes one or more strength-reinforcing, tensioned steel straps adapted for transferring an intermediate lateral load acting on the member to its supported ends. The invention is applicable to standard light-gauge steel C-channels, U-channels, Z-purlins, I-beams, and girts, square tubing, and light-gauge prefabricated building sections, such as floor trusses, stud or curtain walls, and roof panels. The invention provides a lightweight structural member with an extended span reach, and which is less costly and more functional than existing structures of equivalent strength and span.

A principle object of the invention is to create a maximum supporting reaction force at a predetermined location between the ends of the structural member in a manner that will not significantly increase the weight and/or cost of the member. The invention will double the span of the structural member without reducing its load-bearing capacity. For example, a standard 24 foot beam has a maximum supporting reaction force at its supported ends and a minimum supporting reaction force at its center point 12 feet from either end. Longer beams have less strength at the center point, and must therefore be made of a heavier gauge steel or must include separately attached reinforcing structure which can substantially increase the overall weight and cost of the beam. The present invention adds low cost, lightweight reaction support at the center point of the beam, thereby shifting the area of less strength to respective mid-points between the center and ends of the beam.

Attempts have been made in the past to strengthen conventional beams using or more steel cable tendons attached to opposite ends of the beam in tension, and forced downwardly and attached at intermediate points of the beam. Cable tendons, however, are costly and generally too elastic to maintain proper tension over time. For example, for every 1/50th of an inch of relaxing tension on a steel cable under 2500 lbs. of tension, residual tension in the cable is reduced by 100 lbs. To control elongation, the cables are typically pretensioned and imbedded in relatively heavy cement-type material and held rigid the full length of the beam. This is not an option with light-gauge structural members.

SUMMARY OF THE INVENTION

Therefore, it is an object of the invention to provide a lightweight structural member which can span twice the distance of a conventional member without reducing its load-bearing capacity.

It is another object of the invention to provide a structural member which has twice the load-bearing capacity of a conventional member of substantially equal length.

It is another object of the invention to provide a structural member which is relatively inexpensive to manufacture.

It is another object of the invention to provide a structural member which uses a strength-reinforcing, flat steel strap which resists stretching under lineal tension.

It is another object of the invention to provide a structural member including a tensioned flat steel strap which will maintain a predetermined degree of tension over time.

It is another object of the invention to provide a structural member including a tensioned flat steel strap with a tensile strength of between 100,000 and 140,000 psi.

It is another object of the invention to provide a structural member including a tensioned flat steel strap which is stress-proof.

It is another object of the invention to provide a structural member including a tensioned flat steel strap which is tension-tested.

It is another object of the invention to provide a structural member including a tensioned flat steel strap which is anchored at opposing ends of the member without penetrating the strap from one major surface to the other.

It is another object of the invention to provide a structural member which uses two or more strength-reinforcing flat steel straps.

It is another object of the invention to provide a structural member which can be quickly and easily assembled.

It is another object of the invention to provide a structural member which is clearly marked to indicate the horizontal and vertical tension pulled on the steel strap.

It is another object of the invention to provide a method of forming a load-bearing structural member.

These and other objects of the present invention are achieved in the preferred embodiments disclosed below by providing a load-bearing structural member including an elongate beam and a strength-reinforcing flat steel strap. The beam has a top and a bottom, and first and second opposing ends. The steel strap extends along the length of the beam from one end to the other, and is adapted for transferring an intermediate load acting on the beam outwardly to the opposing ends of the beam. Anchoring means located at respective opposing ends of the beam engage and hold the strap in tension.

According to one preferred embodiment of the invention, the strap is anchored to the opposing ends of the beam at the top of the beam. A vertical tensioning post located between the ends of the beam engages and holds the strap adjacent the bottom of the beam. The tensioning post and strap cooperate to create an increased supporting reaction force between the ends of the beam at the location of the post.

According to another preferred embodiment of the invention, the vertical tensioning post is centrally located between the ends of the beam.

According to yet another preferred embodiment of the invention, the strap is formed of light-gauge, stress-proof steel having a tensile strength of at least 100,000 psi.

According to yet another preferred embodiment of the invention, the beam is formed of light-gauge steel.

According to yet another preferred embodiment of the invention, the beam has a generally V-shaped or U-shaped cross-section with a bottom, opposing sides integrally formed with the bottom, and respective flanges integrally formed with the sides.

According to yet another preferred embodiment of the invention, each of the flanges includes a longitudinal fastener groove for receiving fasteners.

According to yet another preferred embodiment of the invention, at least one lateral spreader bar is located between the sides of the beam to maintain uniform spacing of the sides from one end of the beam to the other.

According to yet another preferred embodiment of the invention, the anchoring means includes cooperating top and bottom anchor plates attached to each end of the beam. The anchor plates engage opposing major surfaces of the flat steel strap to frictionally hold the strap in tension without penetrating the strap from one major surface to the other.

According to yet another preferred embodiment of the invention, the anchor plates include a series of mating, spaced-apart, lateral crimps.

According to yet another preferred embodiment of the invention, the depth of the crimps formed in the anchor plates increases from an inside edge of the plates to an outside edge of the plates.

According to yet another preferred embodiment of the invention, the width of the crimps formed in the anchor plates is no greater than 80% of the width of the strap.

According to yet another preferred embodiment of the invention, the anchor plates are attached to the beam by a plurality of fasteners extending through the beam and plates, and adjacent to opposing side edges of strap.

According to yet another preferred embodiment of the invention, the anchor plates extend at an angle from the top of the beam towards the bottom of the beam to define a sloping bed for holding the strap.

According to yet another preferred embodiment of the invention, the beam is a steel C-channel including a vertical web member and spaced-apart top and bottom flange members integrally formed with the web member.

According to yet another preferred embodiment of the invention, top and bottom support panels are attached to respective top and bottom flange members of the C-channel.

According to yet another preferred embodiment of the invention, the flange members include respective integrally-formed hooks adapted for mating with complementary hooks formed with respective top and bottom panels for connecting the panels and the beam together.

In another embodiment, the invention includes a method of forming a load-bearing structural member including the steps of anchoring one end of a strength-reinforcing flat steel strap to one end of a beam, and pulling an opposing end of the strap towards an opposing end of the beam to tension the strap. The opposing end of the strap is then anchored to the opposing end of the beam. The strap is held in tension between the ends of the beam and is adapted for transferring an intermediate load acting on the beam outwardly towards the ends of the beam.

According to another preferred embodiment of the invention, the method includes anchoring the strap to the opposing ends of the beam at a top of the beam, and then applying a downward vertical force to the strap at a point intermediate of the opposing ends. The strap is then held to the beam at the intermediate point adjacent a bottom of the beam without welding or attaching to the top of the beam, thereby creating an increased supporting reaction force between the ends of the beam at the intermediate point.

According to yet another preferred embodiment of the invention, the method includes marking the tension force applied to the strap on a surface of the beam.

BRIEF OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
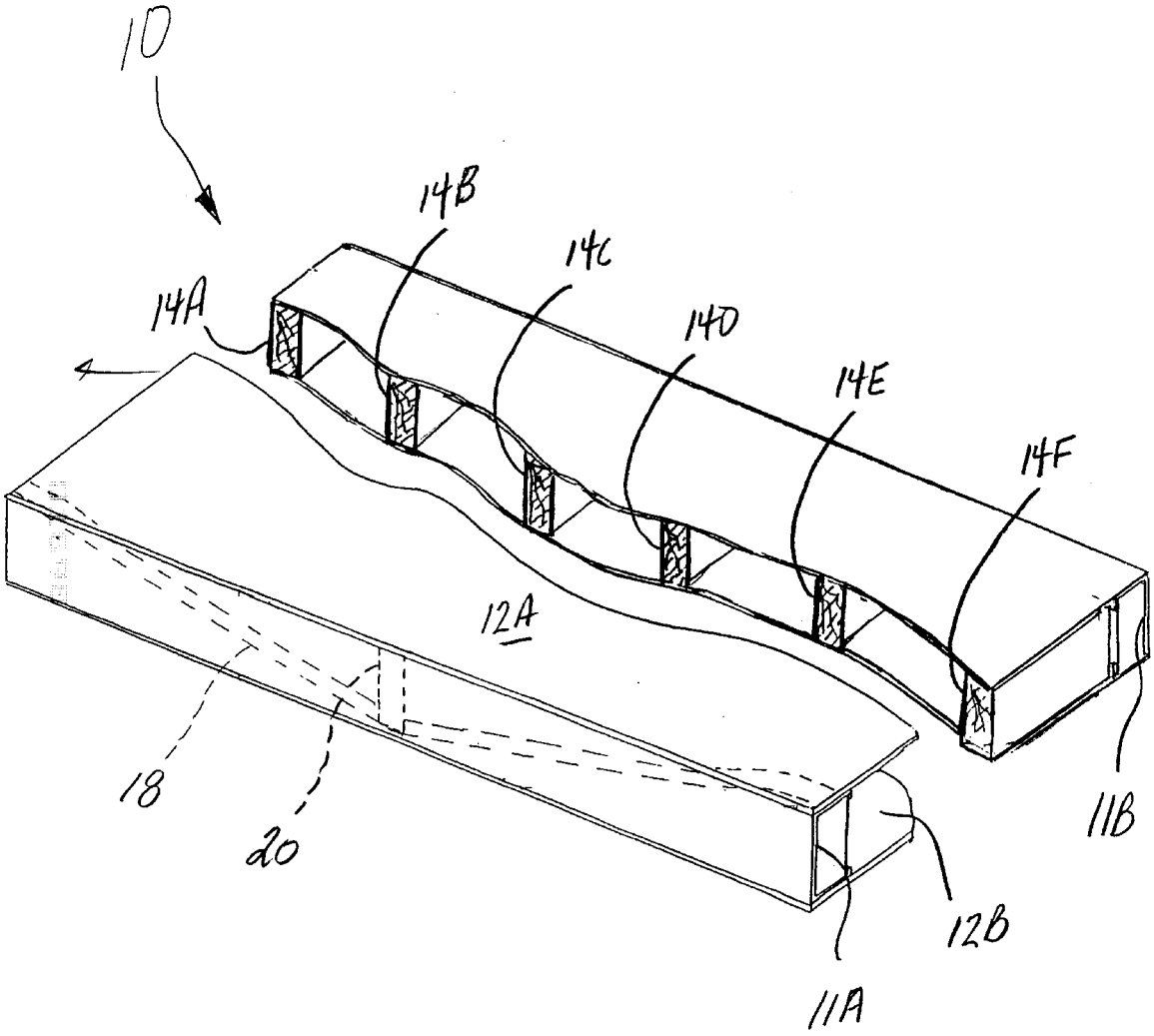
FIG. 1 is a fragmentary, perspective view of a structural member according to one preferred embodiment of the present invention, and showing the tensioned strap in phantom.
Figure 6:
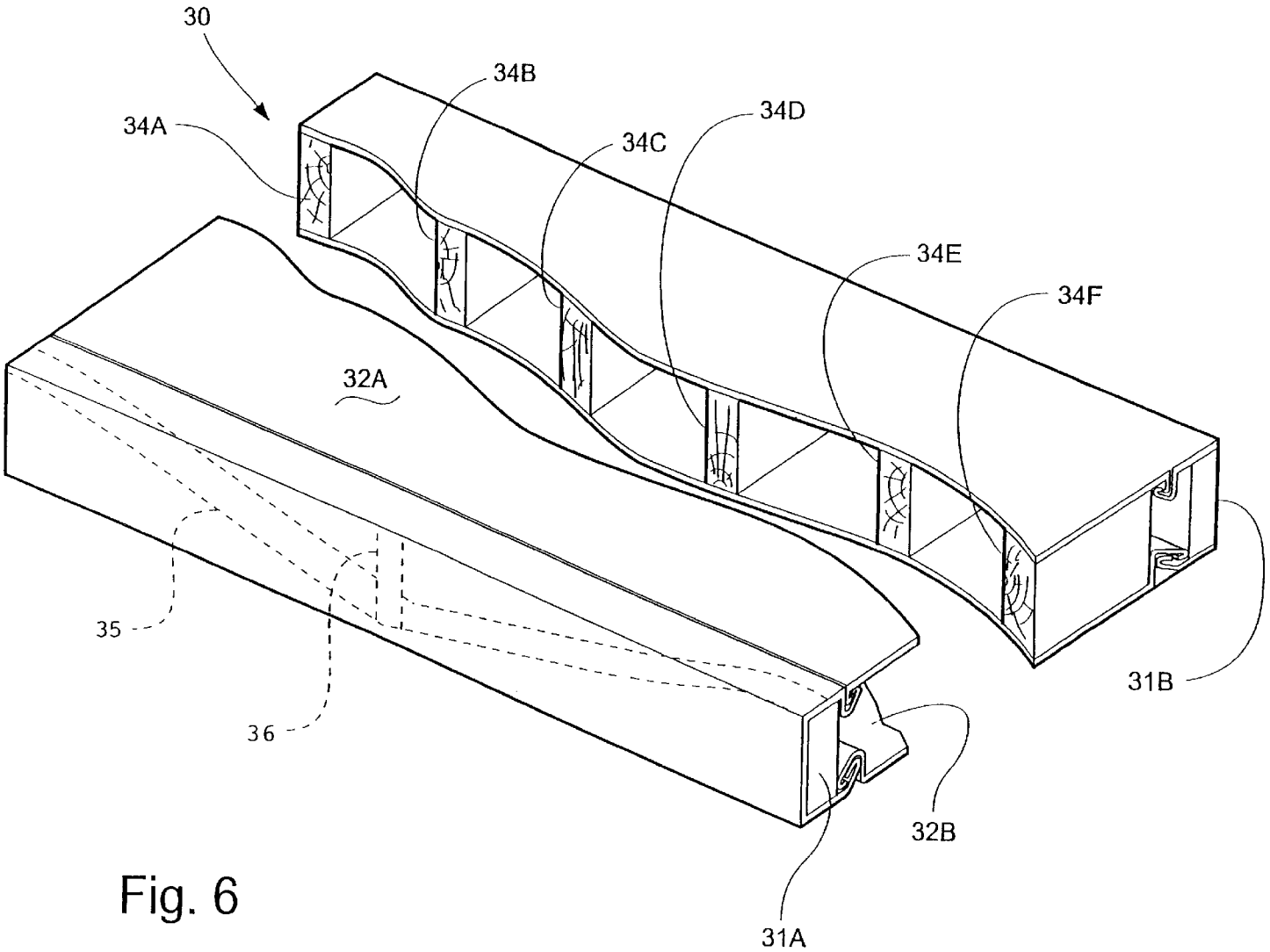
FIG. 6 is a fragmentary, perspective view of a structural member according to a second preferred embodiment of the invention with the tensioned strap.
Figure 8:
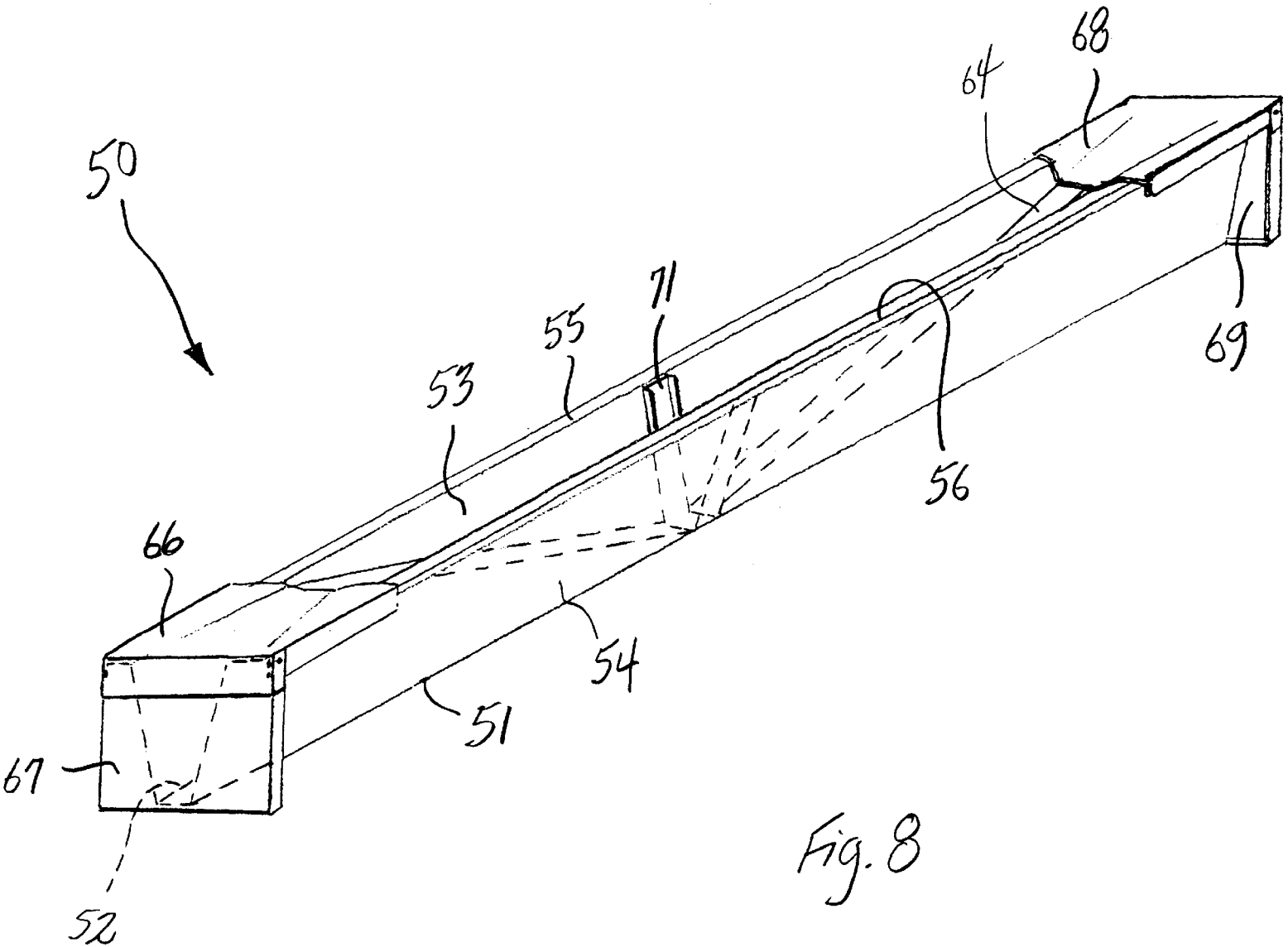
FIG. 8 is a perspective view of a structural member according to a third preferred embodiment of the invention with the tensioned strap shown in phantom.

Referring now specifically to the drawings, a load-bearing structural member according to the present invention is illustrated in FIG. 1 and shown generally at reference numeral 10. The structural member 10 may comprise, for example, a light-weight prefabricated floor or roof truss, such as shown in FIGS. 1 and 6, a stud or curtain wall, or a single strength-reinforced beam assembly, such as shown in FIG. 8.

Figure 2:
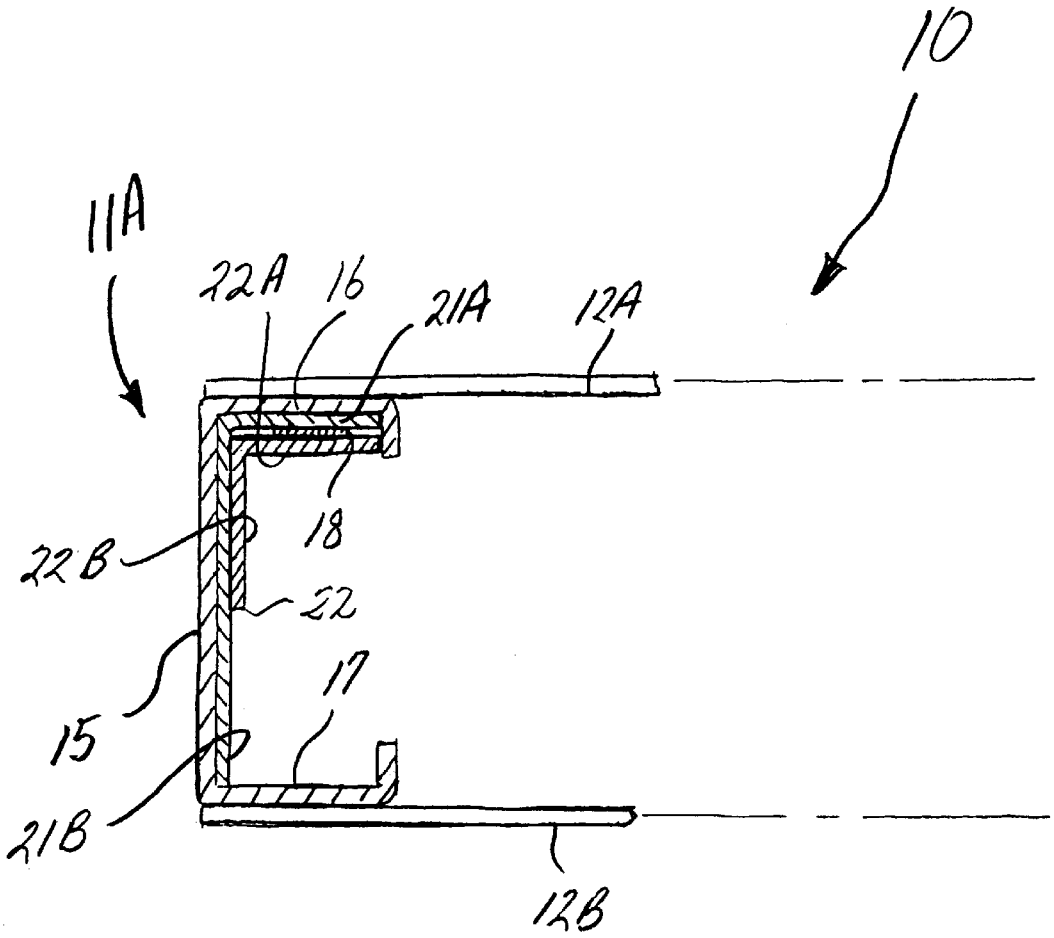
FIG. 2 shows a fragmentary, lateral cross-section of the structural member.
Figure 3:
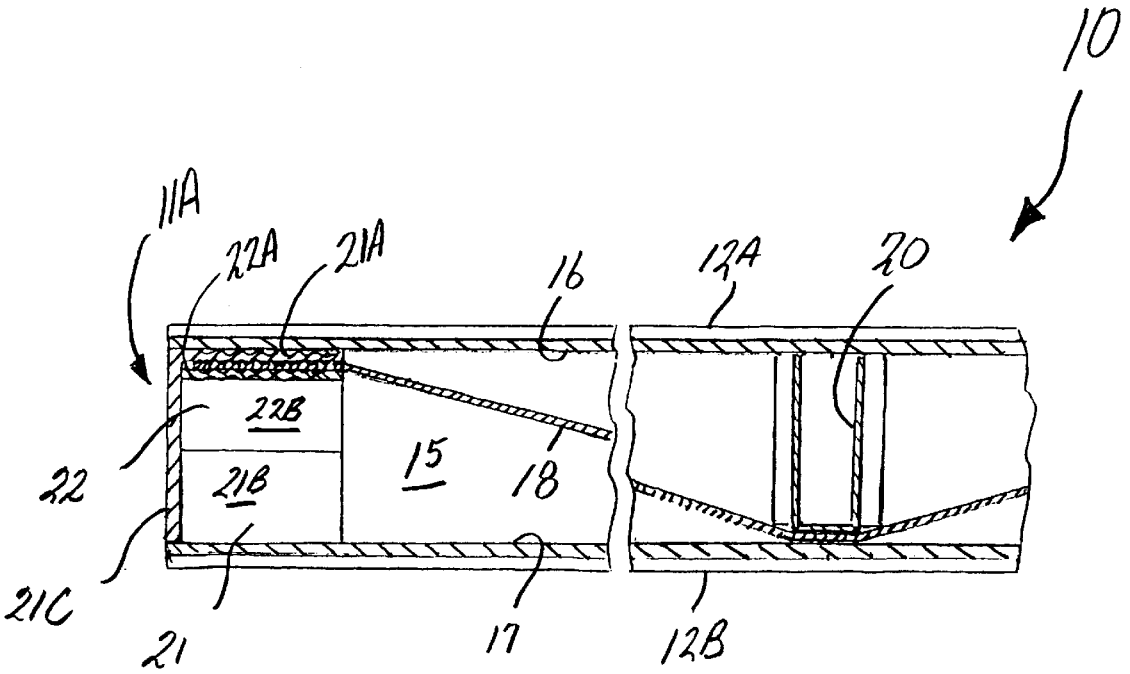
FIG. 3 shows a fragmentary, longitudinal cross-section of the structural member.

Referring to FIGS. 1–3, the structural member 10 is constructed of identical, spaced-apart, light-gauge steel beams 11A and 11B, top and bottom panels 12A and 12B attached to the beams 11A and 11B, and a number of spaced-apart lateral cross braces 14A–14F. The gauge of steel used for each beam 11A, 11B is preferably between 16 and 18. The term "beam" as used herein is broadly defined as any structure with one dimension large as compared to the other dimensions, and whose function is to carry loads perpendicular to the large dimension.

The top and bottom panels 12A and 12B are formed of plywood, sheet rock, or light-gauge steel in the range of 18 to 20. The panels 12A, 12B are attached to the beams 11A, 11B using metal screws, rivets or other suitable fasteners (not shown). The cross braces 14A–14F are preferably formed of wood or light-gauge steel channel or tubing, and are attached to the panels 12A, 12B using metal screws, rivets or other fasteners (not shown). A single strength-reinforced beam 11A is described below.

As best shown in FIGS. 2 and 3, the beam 11A is an 8 in.×1.5 in.×24 ft.×18 ga. steel C-channel with a vertical web member 15 and opposing, integrally-formed top and bottom flange members 16 and 17. A flat, pretensioned, stress-proof steel strap 18 is secured in tension to opposing ends of the beam 11A at an underside of the top flange member 16, and is pulled downwardly towards the bottom flange 17 at a center point of the beam 11A and held by a vertical tensioning posting 20 attached to the web member 15. Unlike steel cables, the tensioned strap 18 resists stretching and reduction in lineal tension over time, and has superior strength to weight to size ratio. In the embodiment shown, the tensioned strap 18 used is 1.5 in.×5000 lbs.×0.031 in., and is tension tested to 130,000 psi. A minimum tensile strength of 100,000 psi is preferred.

The ends of the tensioned strap 18 are anchored adjacent the underside of the top flange member 16 of the beam 11A using respective pairs of inside and outside anchor plates 21 and 22. The inside anchor plate 21 includes a top wall 21A residing adjacent the top flange member 16, a side wall 21B residing adjacent the web member 15, and an end wall 21C covering the end of the beam 11A. The outside anchor plate 22 includes a top wall 22A, and a side wall 22B residing adjacent the side wall 21B of the inside anchor plate 21. The anchor plates 21, 22 are attached together and to the beam 11A using suitable fasteners (not shown), and cooperate to sandwich the end of the tensioned strap 18 between their respective top walls 21A and 22A to frictionally hold the strap 18 to the beam 11A.

Figure 4:
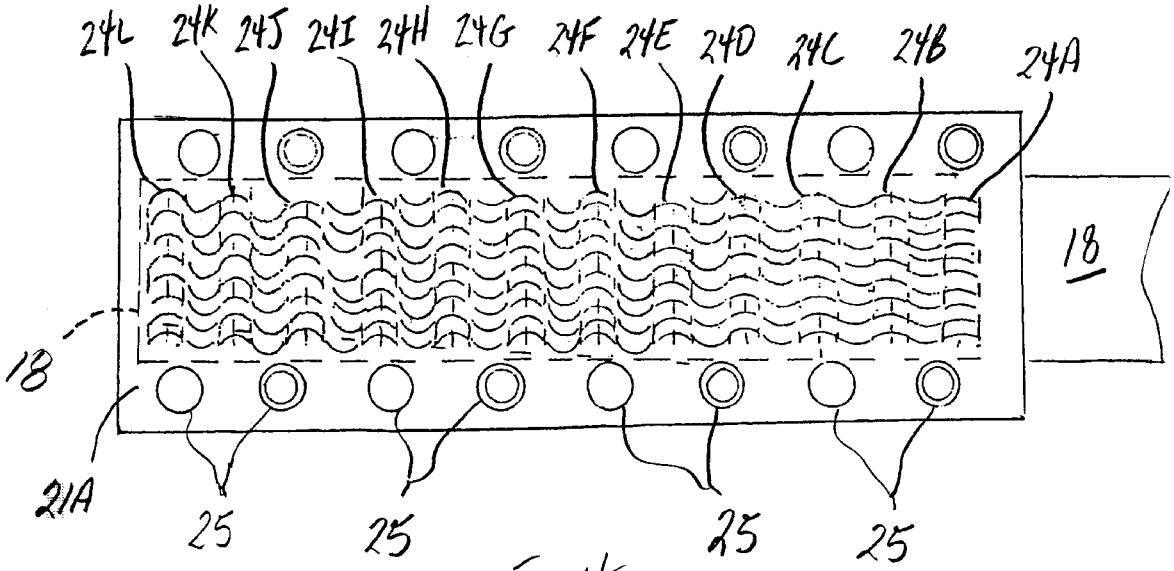
FIG. 4 is a top plan view of the inside anchor plate with an end portion of the tensioned strap shown in phantom.
Figure 5:
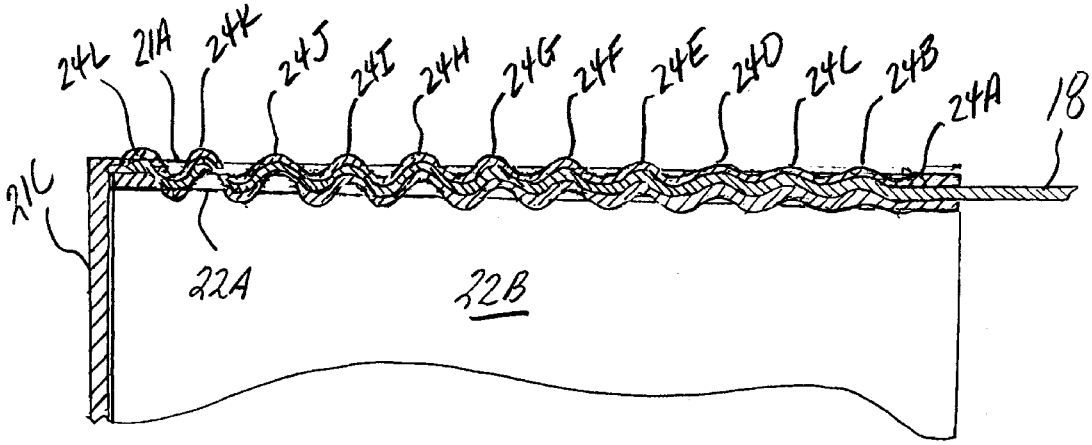
FIG. 5 shows a fragmentary, longitudinal cross-section of the inside and outside anchor plates with the tensioned strap held between the mating crimps.

The top walls 21A, 22A include a series of mating crimps 24A–24L, shown in FIGS. 4 and 5, which engage the tensioned strap 18 to further increase the friction holding strength of the anchor plates 21 and 22. The crimps 24A–24L are preferably stamped into the top walls 21A, 22A and tensioned strap 18 simultaneously prior to attaching the anchor plates 21, 22 to the beam 11A. When forming the crimps 24A–24L, care must be taken to avoid crimping, penetrating or distorting either longitudinal side edge of the tensioned strap 18. The side margins of the tensioned strap 18 should stay flat and straight to prevent the formation of weak spots where fatigue or breakage could occur. As best shown in FIG. 4, the crimps 24A–24L preferably reach only 80% of the width of the strap 18 with the ends of each crimp tapering to a flat surface. A number of fastener holes 25 are formed through the anchor plates 21, 22 on opposite sides of the crimped area for receiving respective fasteners through the top flange member 16 and anchor plates 21, 22 without engaging the strap 18.

According to the preferred embodiment shown, a series of 12 mating crimps 24A–24L cooperate to hold the tensioned strap 18 between the top walls 21A and 22A of the anchor plates 21 and 22. The crimp pattern is strategic. The first crimp 24A starts ⅜ in. from the inside edge of the anchor plate 21, and has an arc radius of 0.25 times the thickness of the tensioned strap 18. The second crimp 24B has an arc radius of 0.5 times the thickness of the strap 18. The third crimp 24C has an arc radius of 0.75 times the thickness of the strap 18. The fourth crimp 24D has an arc radius equal to the thickness of the strap 18. The fifth crimp 24E has an arc radius of 1.25 times the thickness of the strap 18. The sixth and succeeding crimps 24F–24L have respective arc radiuses of 1.5 times the thickness of the strap 18. The optimal distance between each crimp 24A–24L is determined by the thickness of the anchor plates 21, 22 and strap 18, and the tangent of the crimp arc.

Gradual crimping of the tensioned strap 18, as described above, spreads the tension stress over a greater length of the strap 18 to reduce moment fatigue and the likelihood of strap failure. In the embodiment described, five crimps 24 with a crimp radius to 1.5 times the thickness of the strap 18 will generally hold a tension force equal to the tensile strength of the strap 18. To achieve maximum holding strength, it is important that there not be penetration or rupture of the strap 18 during crimping, or in an area of the strap in tension.

The vertical tensioning post 20 is applied to the beam 11A after the desired lineal tension is pulled on the strap 18 and the ends of the strap 18 anchored to the beam 11A, as described above. The strap 18 is pulled vertically downwardly at a center point of the beam 11A, and the tensioning post 20 mounted to the web member 15 to hold the strap 18 in position adjacent the bottom flange member 17. As shown in FIG. 3, minimal clearance is provided between the strap-engaging end of the post 20 and the bottom flange member 17 of the beam 11A. The end of the post 20 is sufficiently wide to engage the entire width of the strap 18. Because of substantial tension in the strap 18, the supporting reaction force on the beam 11A is greatest at the location of the tensioning post 20. Thus, with its ends supported vertically, the beam 11A is capable of carrying a maximum lateral load at its center point. The tensioned strap 18 effectively transfers this load to the supported ends of the beam 11A. The beam 11A is weakest at respective midpoints between the location of the post 20 and the ends of the beam 11A. The top and bottom panels 12A and 12B and cross members 14A–14F help resist the tendency of the beam 11A to buckle inwardly under the tension of the strap 18.

Figure 7:
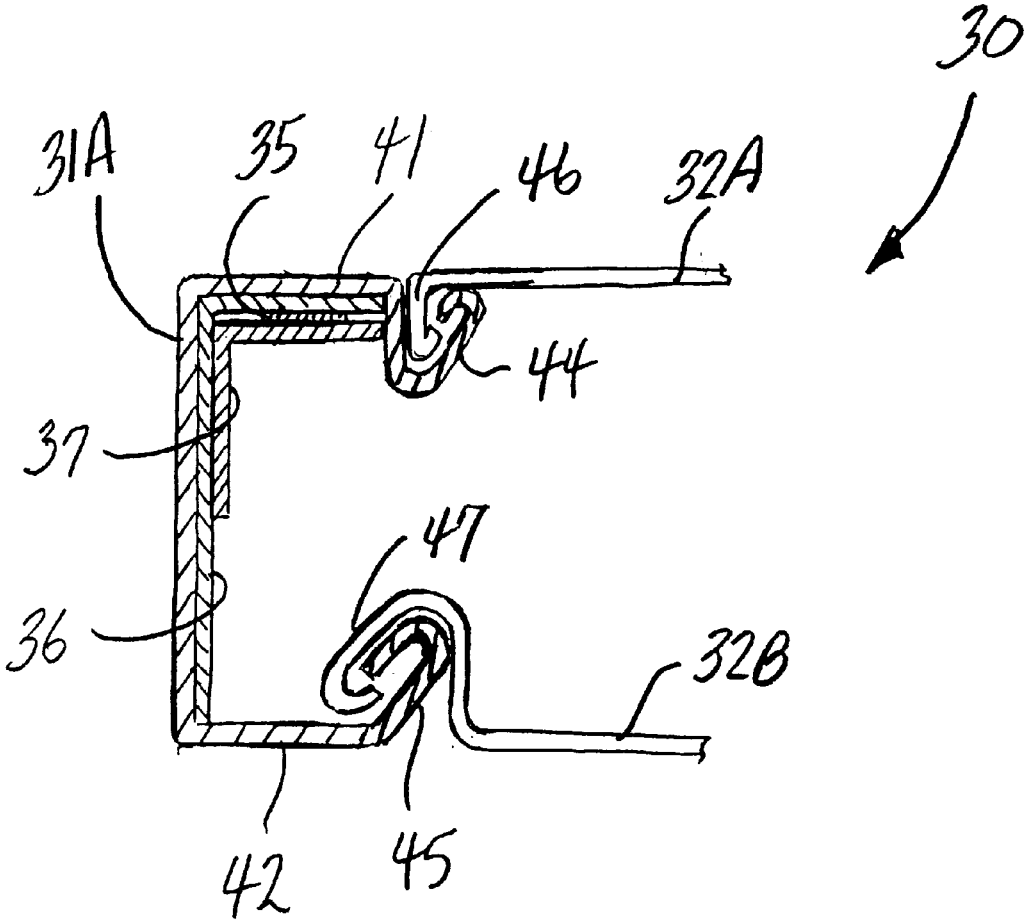
FIG. 7 shows a fragmentary, lateral cross-section of the beam and attached panels.

A further embodiment of a structural member 30 according to the present invention is shown in FIGS. 6 and 7. The structural member 30 is constructed of identical, spaced-apart, light-gauge steel beams 31A and 31B, top and bottom panels 32A and 32B attached to the beams 31A, 31B, and a number of spaced-apart lateral cross braces 34A–34F. Each beam 31A, 31B includes a tensioned steel strap 35 and a vertical tensioning post 36. The strap 35 is attached to opposing ends of each beam 31A, 31B using crimped anchor plates 36 and 37, as previously described.

As shown in FIG. 7, the longitudinal side edges of the flange members 41 and 42 have integrally formed hooks 44 and 45 which mate with complementary hooks 46 and 47 formed with the top and bottom panels 32A and 32B. The complementary hooks 44, 45, 46, and 47 allow ready and convenient assembly of the structural member 30 without risking penetration of the tensioned strap 35 with fasteners entering through the panels 32A, 32B and into the flange members 41 and 42.

A third embodiment of a structural member 50 forming a beam assembly according to the present invention is shown in FIGS. 8–11. The structural member 50 is constructed of a light-gauge steel beam 51 having a generally V-shaped or U-shaped cross-section. The range of steel thickness is preferably between 16 and 20 gauge. The beam 51 includes a bottom 52, opposing sides 53 and 54 integrally-formed with the bottom 52, and respective flanges 55 and 56 integrally-formed with the sides 53 and 54. The flanges 55 and 56 preferably include longitudinal fastener grooves 58 (See FIG. 11) for guiding suitable fasteners used for attaching the structural member 50 to other building members. The longitudinal edges 61 and 62 of the flanges 55 and 56 are folded downwardly to provide increased compression strength. A flat, pretensioned, stress-proof steel strap 64 is secured in tension to opposing ends of the beam 51 by cooperating pairs of anchor plates 66, 67 and 68, 69. The strap 64 is pulled downwardly at a center point of the beam 51, and is held adjacent the bottom 52 by a vertical tensioning post 71 attached to the opposing sides 53 and 54. The tensile strength of the strap 64 is between 100,000 and 140,000 psi.

Figure 9:
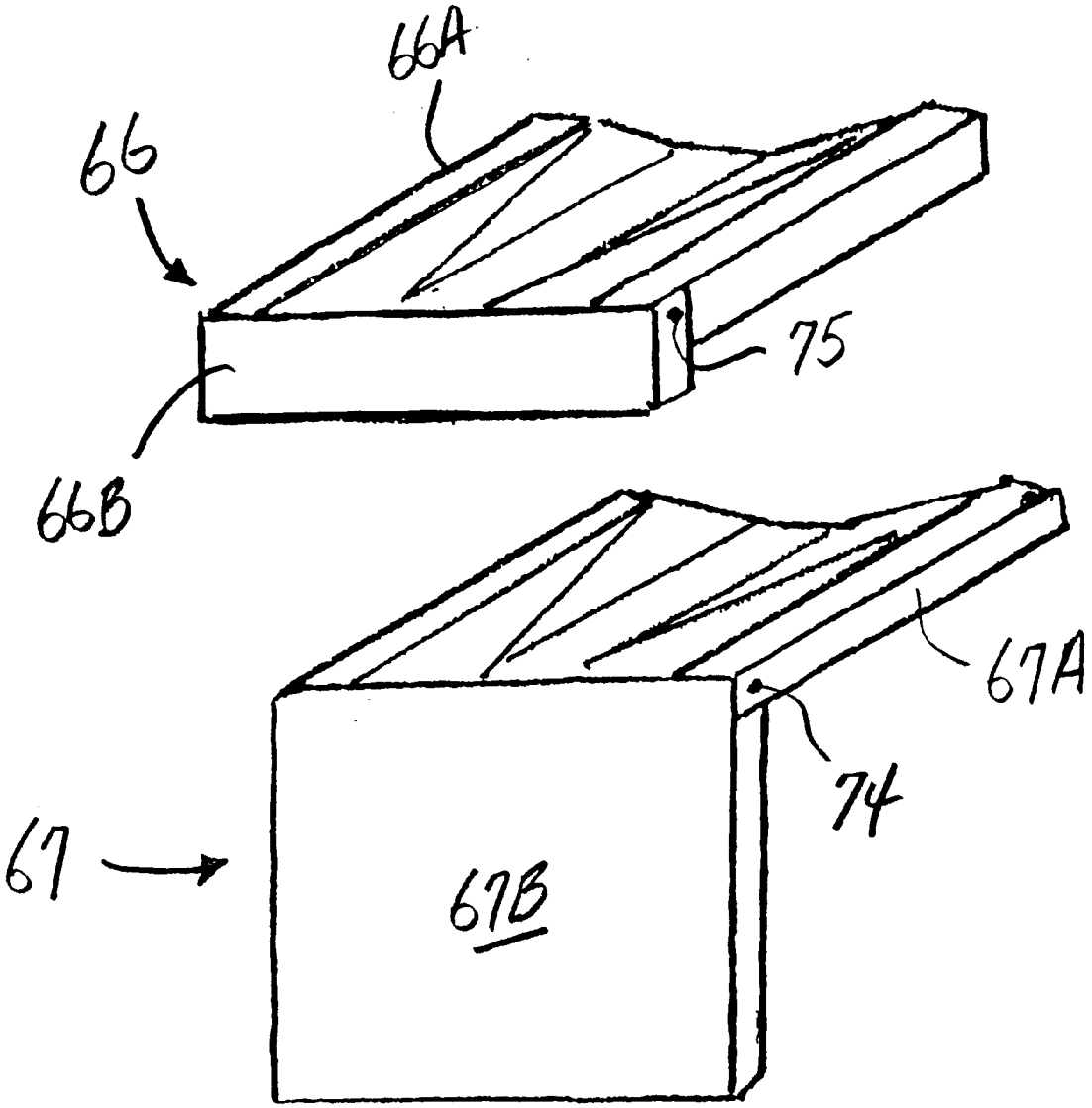
FIG. 9 is an exploded view of the upper and lower anchor plates.
Figure 10:
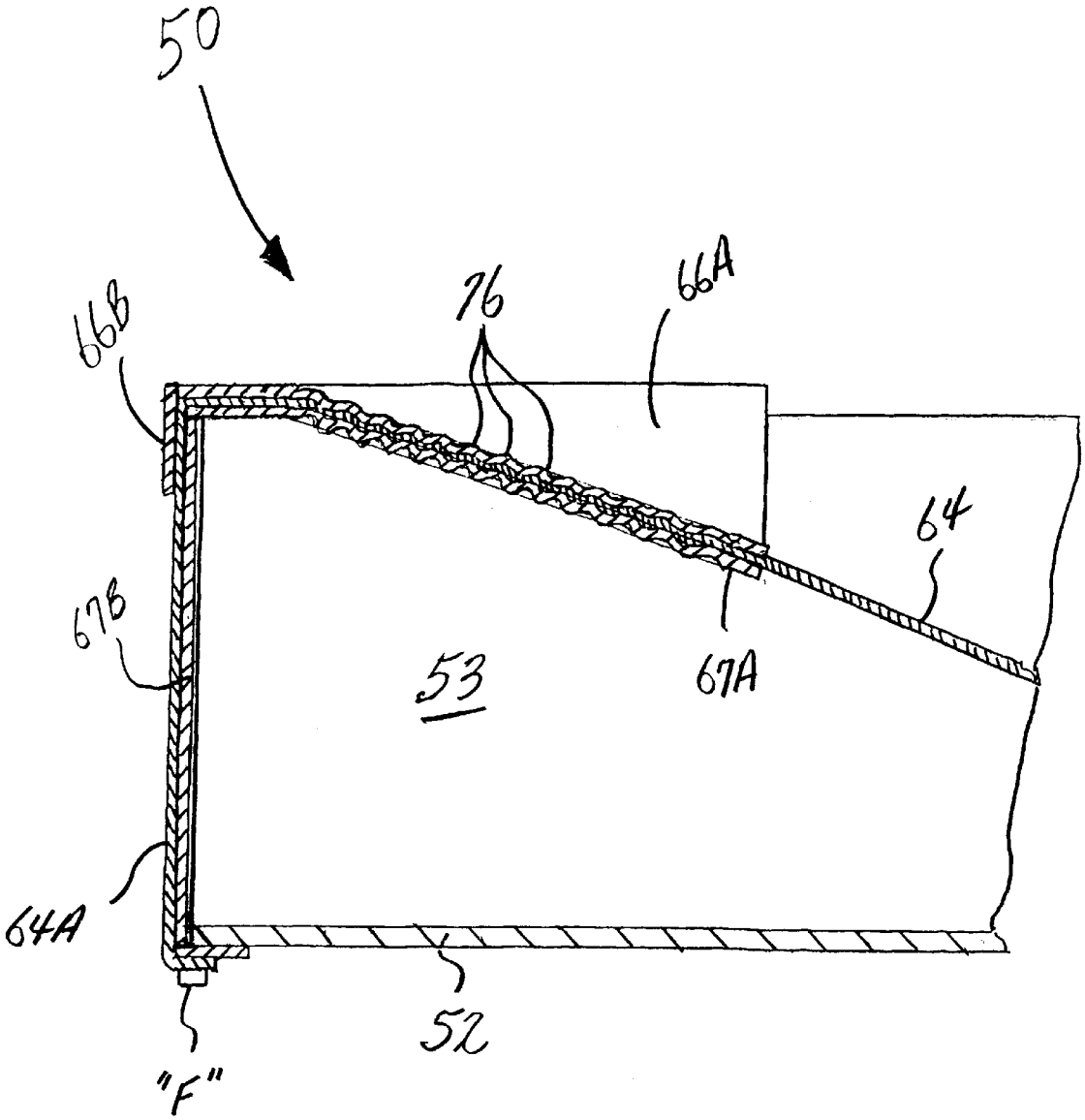
FIG. 10 shows a fragmentary, longitudinal cross-section of the structural member.

Referring to FIGS. 8–10, the lower anchor plate 67 is formed of light-gauge steel bent at an angle to form top and end sections 67A and 67B. The side edges of the sections 67A and 67B are folded perpendicularly inward, and are riveted together at an overlapping common point 74 to form a rigid connection. The top section 67A is angled downwardly towards the bottom 52 of the beam 51 to provide a sloping bed for holding the strap 64. The upper anchor plate 66 is likewise formed of light-gauge steel which is bent at an angle to form top and end sections 66A and 66B. The side edges of the sections 66A, 66B are folded perpendicularly inward, and are riveted together at an overlapping common point 75. The top section 66A is formed at an angle identical to that of the top section 67A of the lower anchor plate 67. The end section 66B resides adjacent the end section 67B of the lower anchor plate 67.

As best shown in FIG. 10, the upper and lower anchor plates 66 and 67 cooperate to sandwich and frictionally hold the tensioned strap 64 to the beam 51. The respective top sections 66A and 67A include a series of mating crimps 76, as described above, which engage the tensioned strap 64 to further increase the friction holding strength of the anchor plates 66 and 67. The crimps 76 are preferably stamped into the top sections 66A and 67A and tensioned strap 64 simultaneously prior to attaching the anchor plates 66 and 67 to the beam 51. The free end 64A of the tensioned strap 64 extends from the upper anchor plate 66 downwardly along the end section 67B of the lower anchor plate 67, and is attached to an inwardly turned bottom edge of the lower anchor plate 67 using a suitable fastener "F". Because the free end 64A of the strap 64 is essentially tension-free, penetration at this point does not weaken the holding strength of the strap 64. The gradual crimp pattern and crimping technique are preferably identical to that previously described. In addition, anchor plates 68 and 69 are identical to plates 66 and 67, respectively, and function in an identical manner to hold the opposite end of the tensioned strap 64 to the beam 51.

Figure 11:
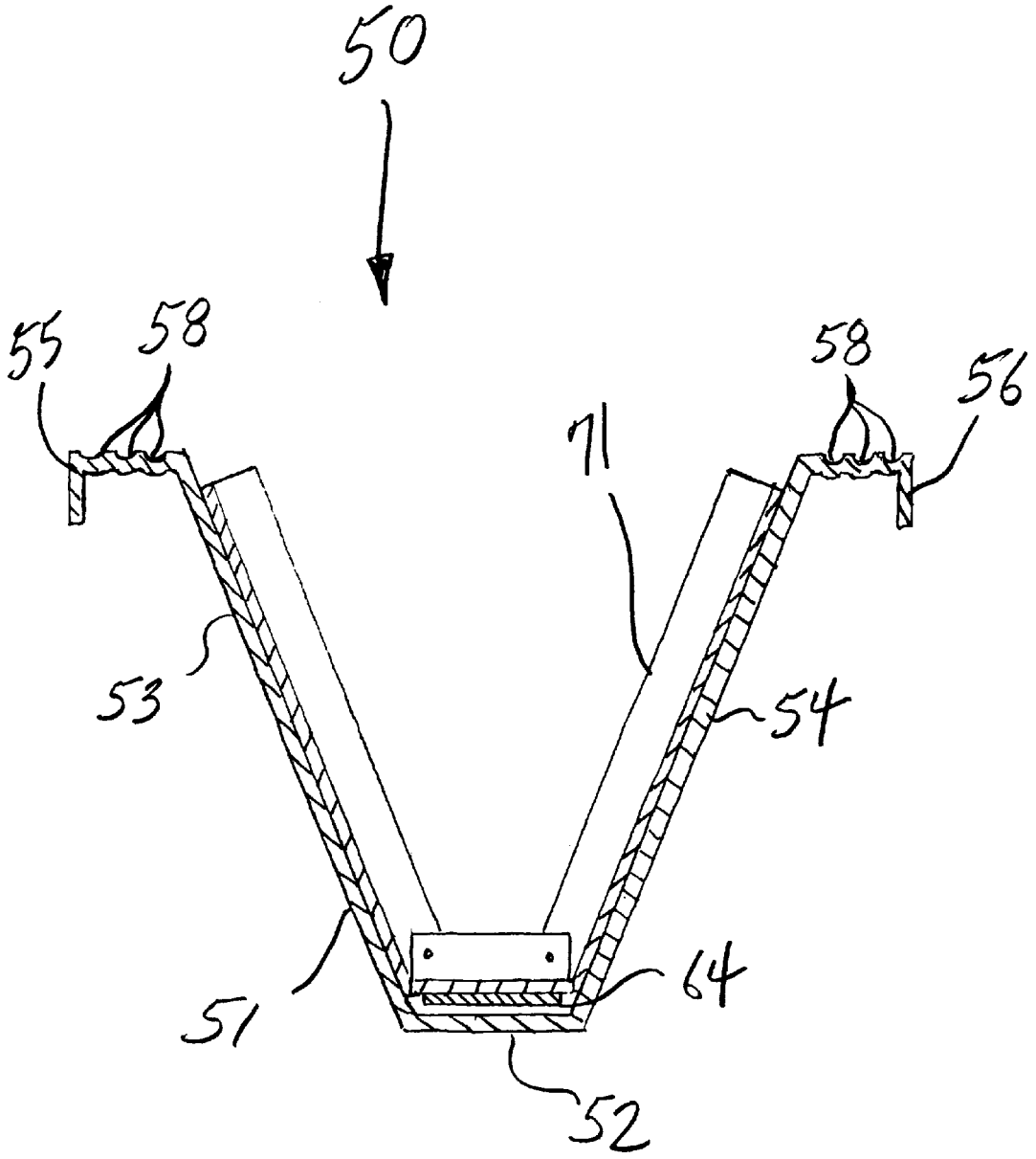
FIG. 11 shows a lateral cross-section of the structural member taken at its center point.
Figure 1:
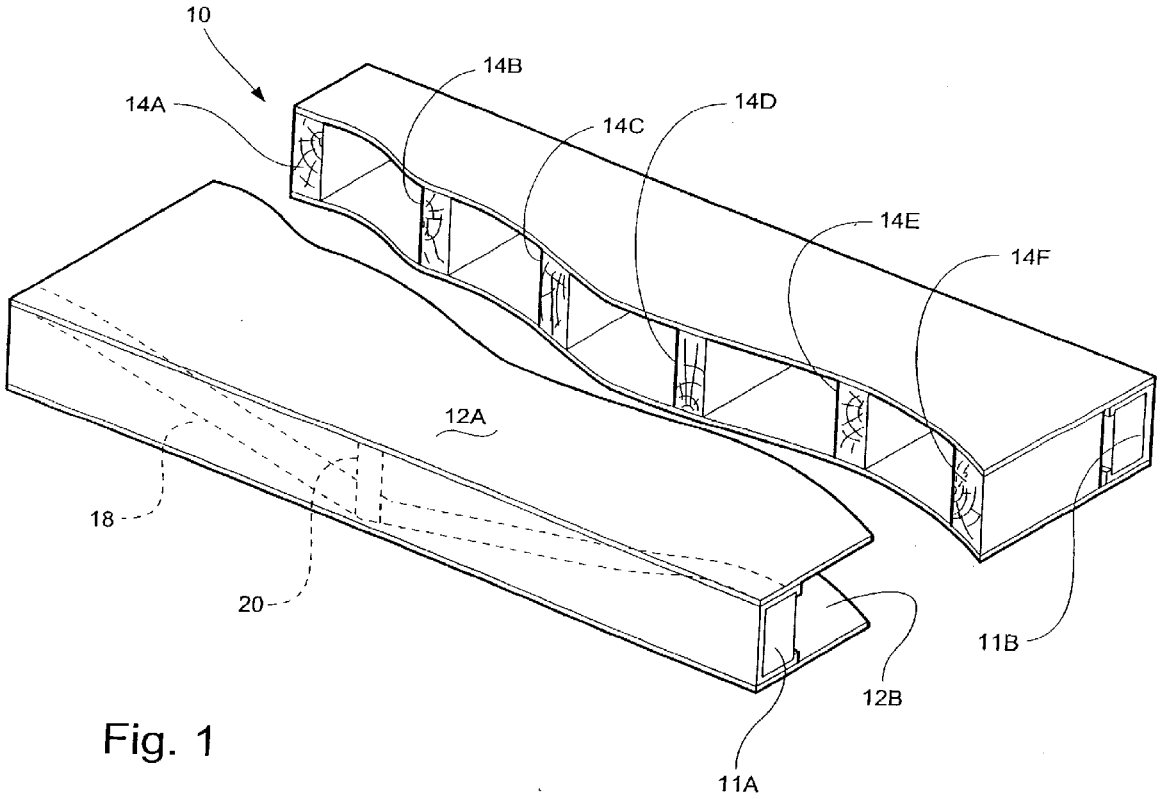
Figure 2:
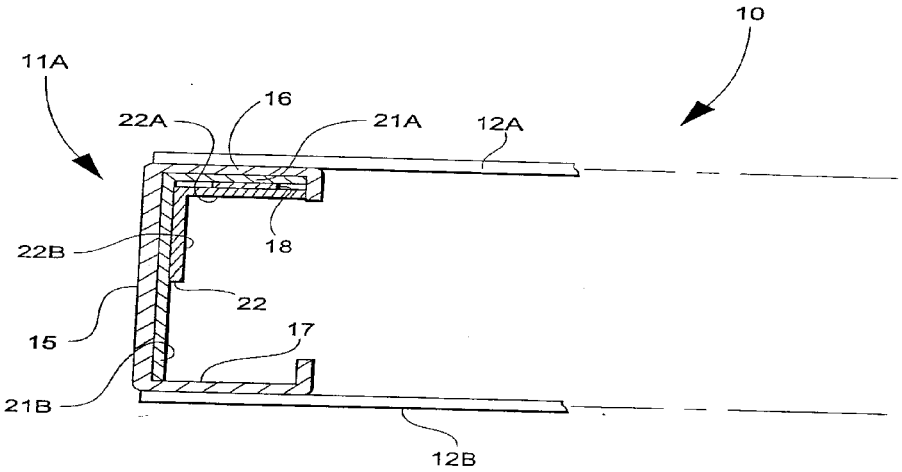
Figure 3:
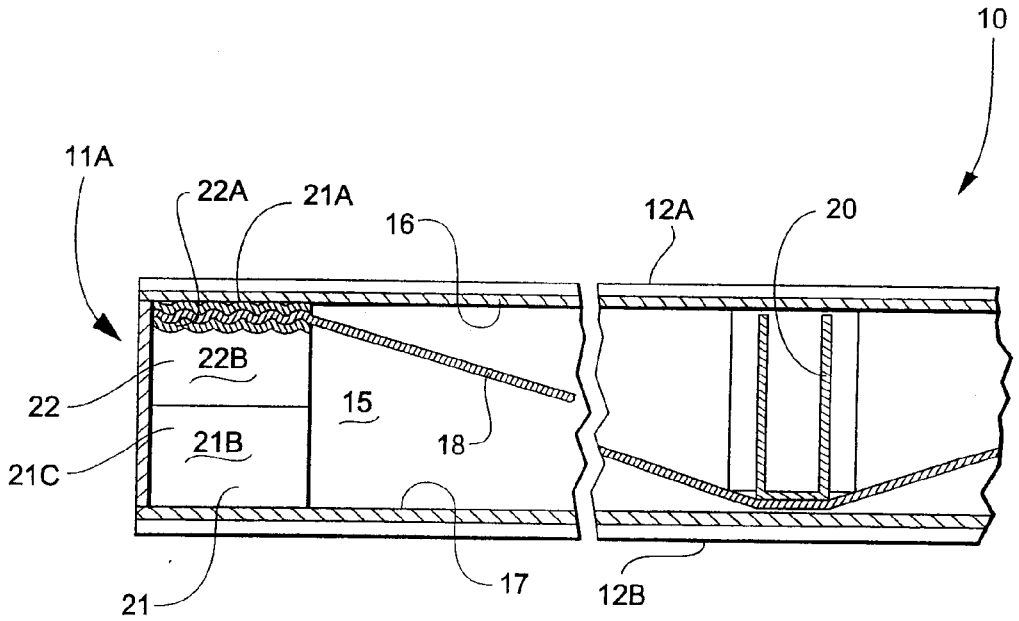
Figure 4:
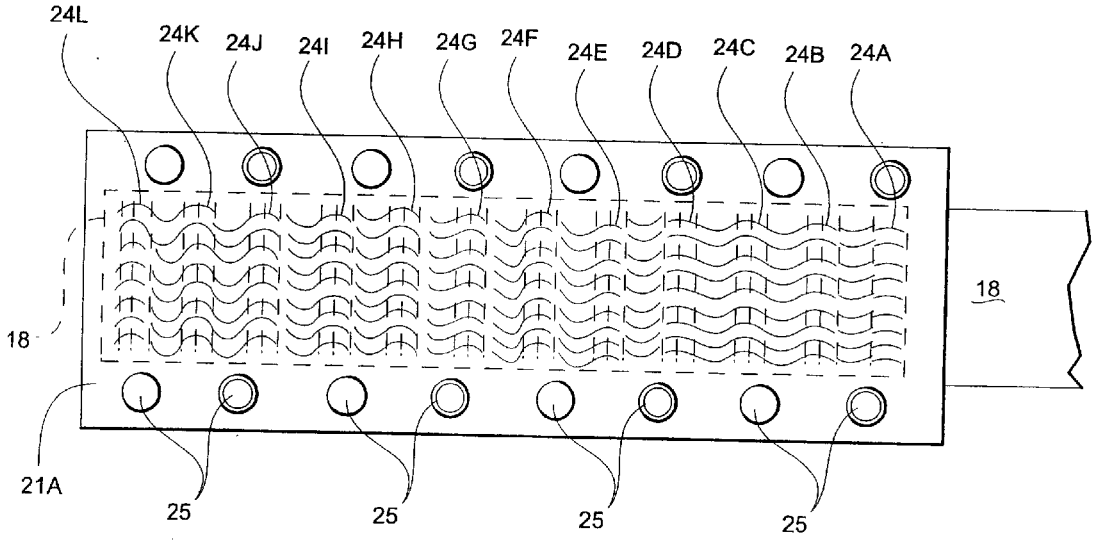
Figure 5:
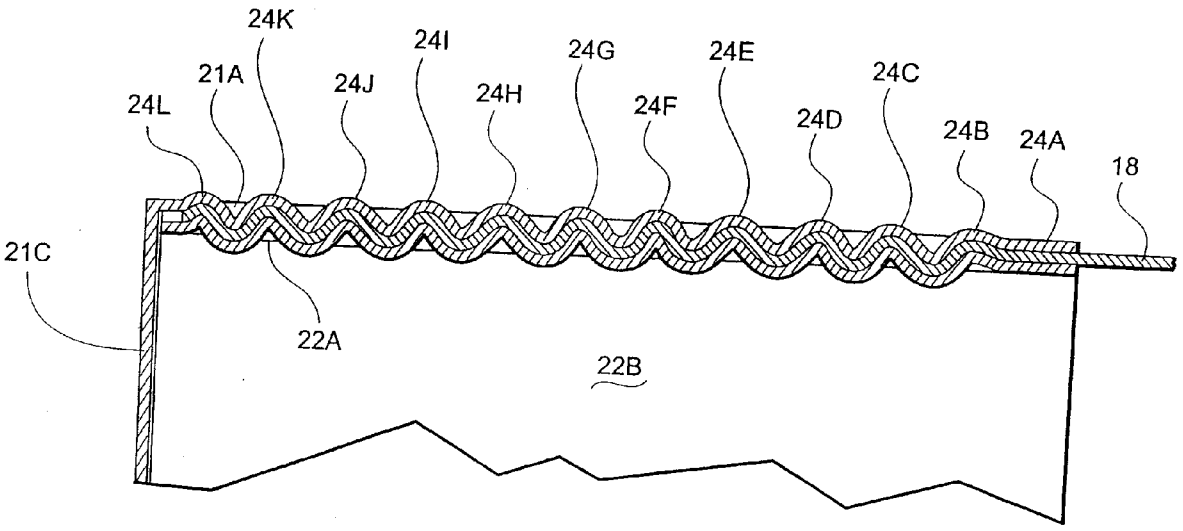
Figure 6:
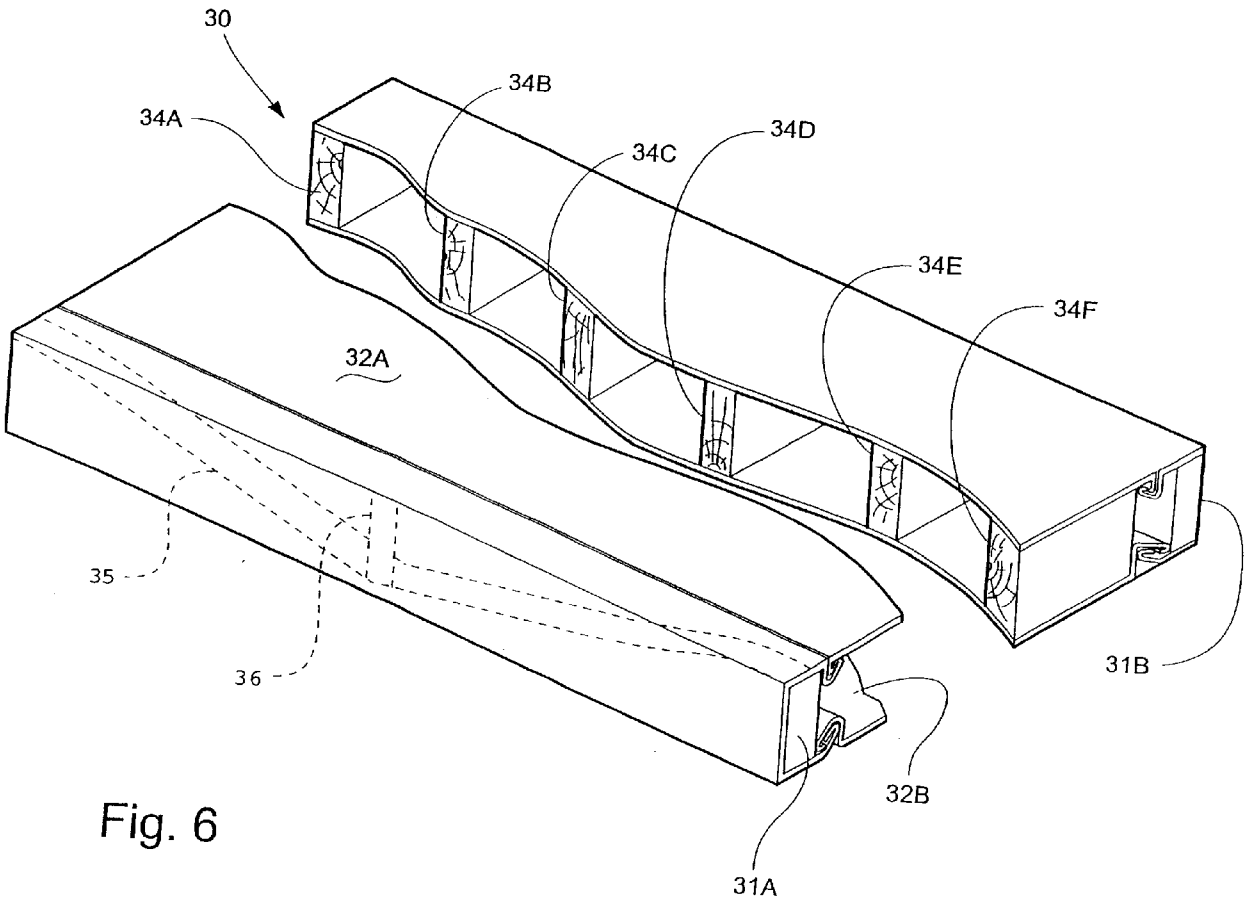
Figure 7:
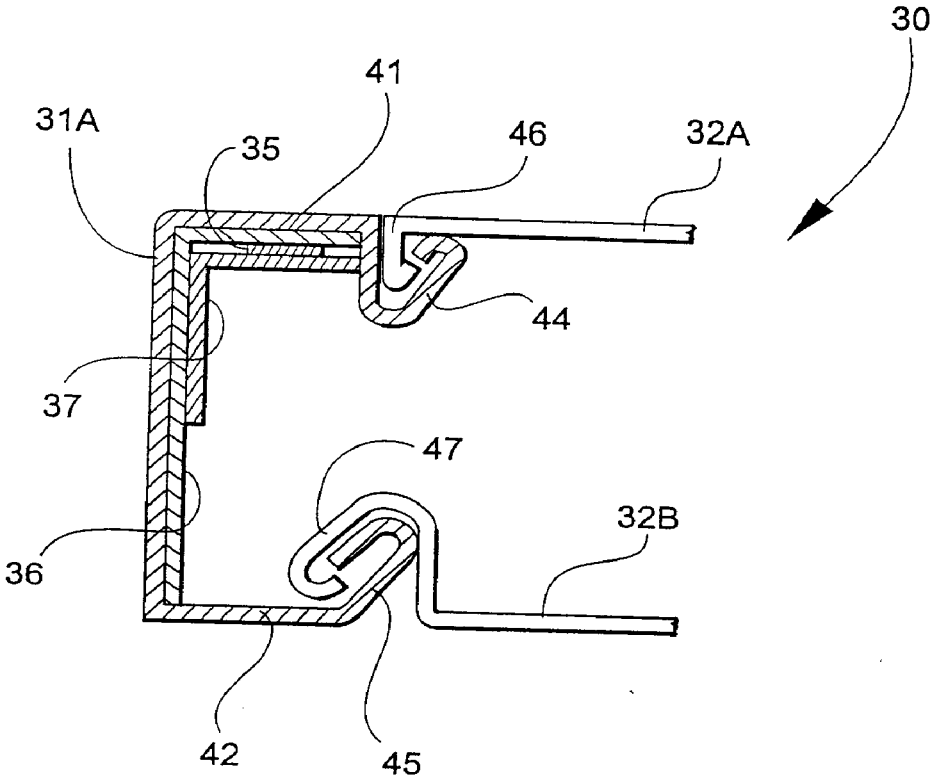
Figure 8:
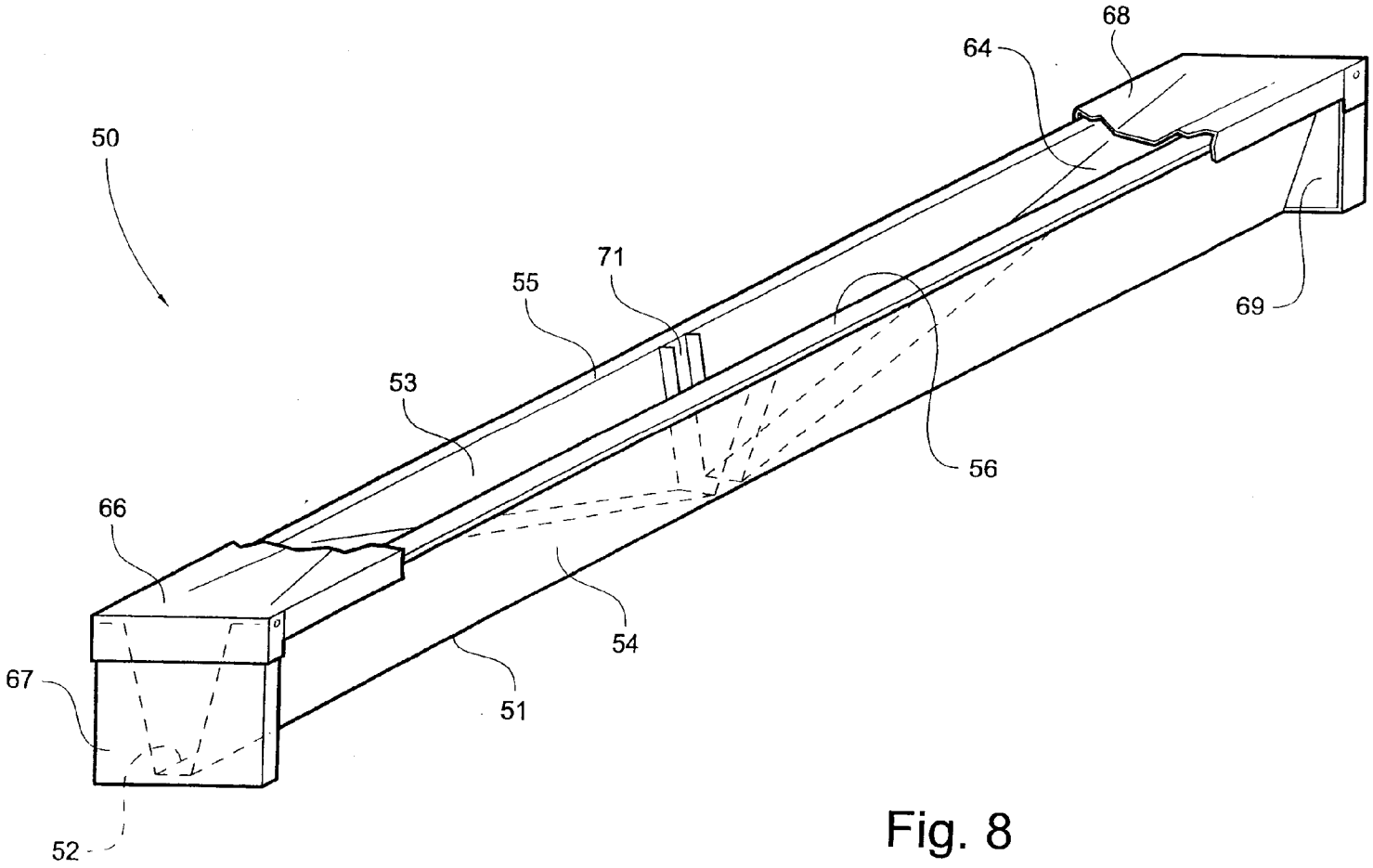
Figure 9:
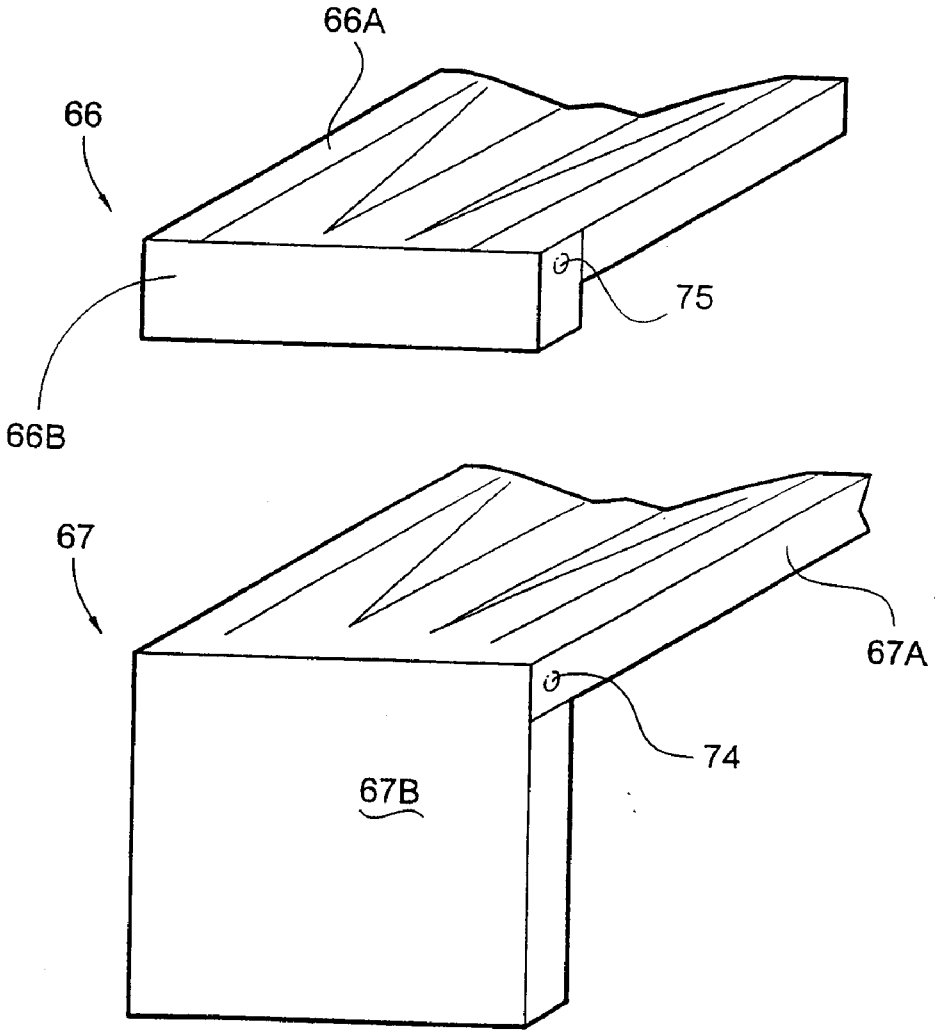
Figure 10:
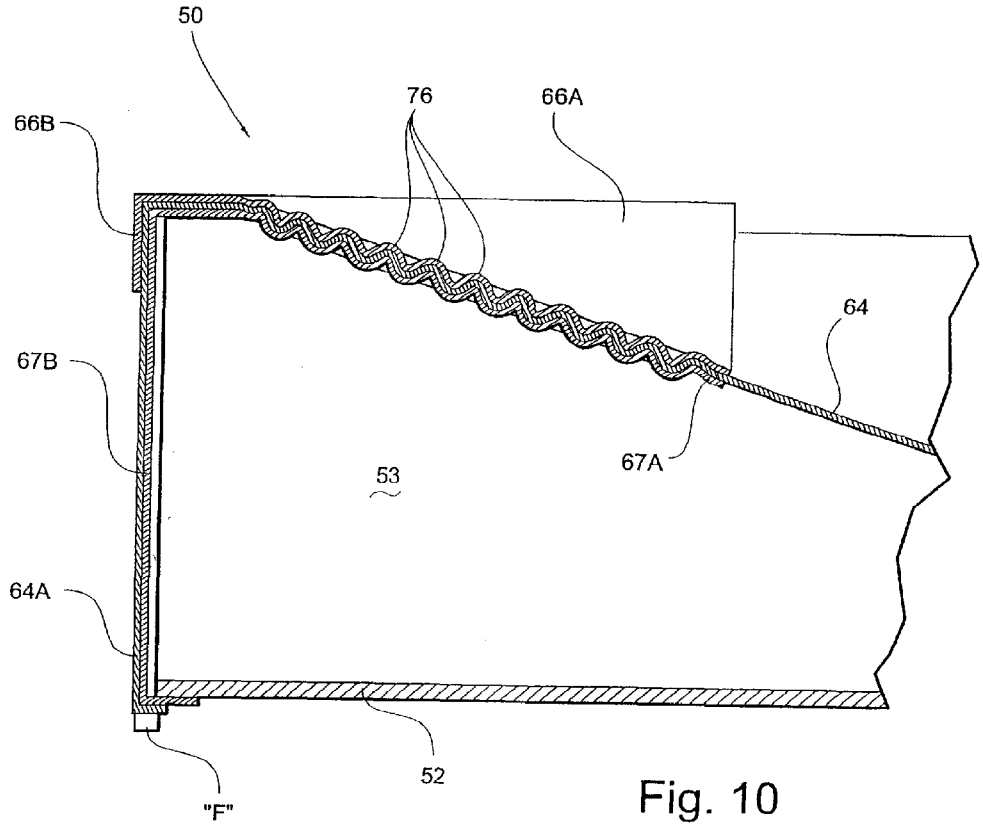
Figure 11:
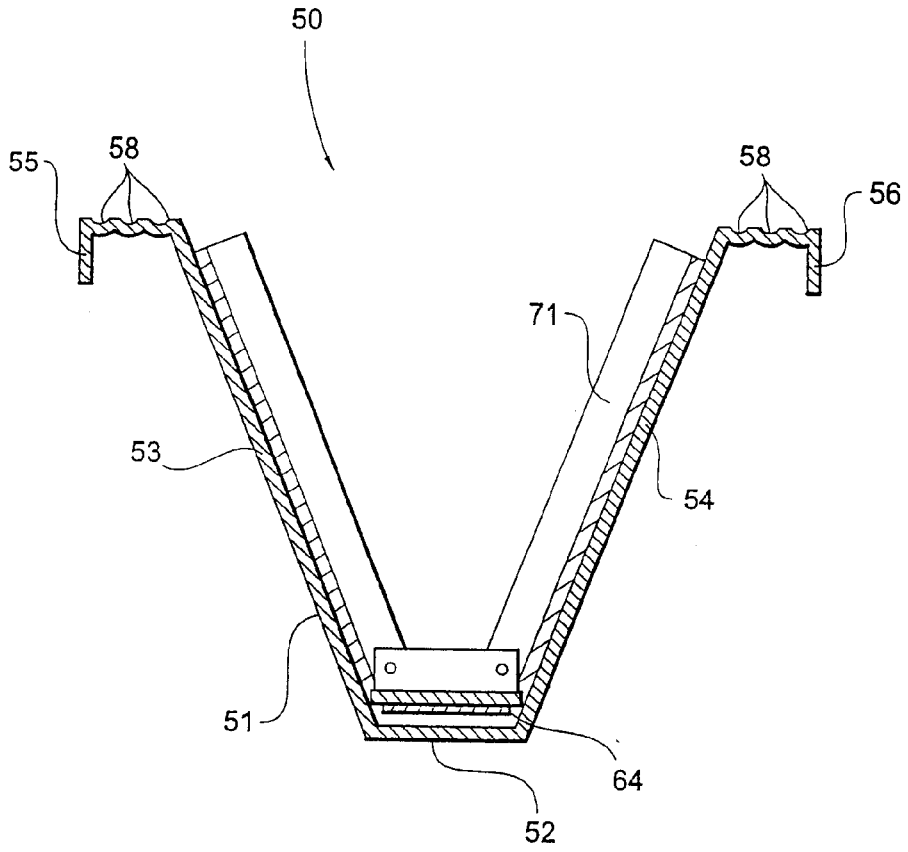

The vertical tensioning post 71 is formed of a steel U-channel cut and folded in the center to fit against the sides 53 and 54 of the beam 51. The overlapping flange portions of the U-channel are preferably riveted together for increased stiffness. The post 71 is applied to the beam 51 after the desired lineal tension is pulled on the strap 64 and the ends of the strap 64 anchored to the beam 51, as described above. The strap 64 is forced vertically downwardly at a center point of the beam 51, and the tensioning post 71 mounted to the side walls 53 and 54 to hold the strap 64 in position adjacent the bottom 52 of the beam 51. As shown in FIG. 11, minimal clearance is provided between the strapengaging end of the post 71 and the bottom 52. The end of the post 71 is sufficiently wide to engage the entire width of the strap 64.

Because of substantial tension in the strap 64, the supporting reaction force on the structural member 50 is greatest at the location of the tensioning post 71. Thus, with its ends supported vertically, the structural member 50 is capable of carrying a maximum lateral load at its center point. The tensioned strap 64 effectively transfers this load to the supported ends of the beam 51. The structural member 50 is weakest at respective mid-points between the location of the tensioning post 71 and ends of the beam 51.

The horizontal and vertical tension forces applied to the strap 64 are preferably marked directly on a surface of the beam 51 to indicate the strength of the structural member 50. For added strength, the structural member may include one or more additional straps and tensioning posts.

A structural member is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A load-bearing structural member, comprising:

(a) an elongate beam having a top and a bottom, and first and second opposing ends;

(b) a strength-reinforcing flat steel strap extending along the length of said beam from one end to the other, and adapted for transferring an intermediate load acting on said beam outwardly to the opposing ends of said beam; and (c) anchoring means located at respective opposing ends of said beam and engaging said strap for holding said strap in tension, said anchoring means comprises cooperating top and bottom anchor plates attached to each end of said beam, and engaging opposing major surfaces of said flat steel strap to frictionally hold said strap in tension without penetrating said strap from one major surface to the other.

2. A load-bearing structural member, comprising:

(a) an elongate beam having a generally V-shaped or U-shaped cross-section, first and second opposing ends, a bottom, opposing sides integrally formed with said bottom, and respective flanges integrally formed with said sides;

(b) a strength-reinforcing flat steel strap extending along the length of said beam from one end to the other, and adapted for transferring an intermediate load acting on said beam outwardly to the opposing ends of said beam; and (c) anchoring means located at respective opposing ends of said beam and engaging said strap for holding said strap in tension.

3. A load-bearing structural member, comprising:

(a) an elongate beam having a top and a bottom, and first and second opposing ends;

(b) a strength-reinforcing flat steel strap extending along the length of said beam from one end to the other, and adapted for transferring an intermediate load acting on said beam outwardly to the opposing ends of said beam; and (c) anchoring means for engaging and anchoring said strap at respective opposing ends of said beam and holding said strap in tension at the top of said beam; and (d) a vertical tensioning post located between the ends of said beam, and engaging and holding said strap adjacent the bottom of said beam, thereby creating an increased supporting reaction force between the ends of said beam at the location of said tensioning post.

4. A structural member according to claim 3, wherein said vertical tensioning post is centrally located between the ends of said beam.

5. A structural member according to claim 3, wherein said strap is formed of light-gauge, stress-proof steel having a tensile strength of at least 100,000 psi.

6. A structural member according to claim 3, wherein said beam is formed of light-gauge steel.

7. A structural member according to claim 3, wherein said beam has a generally V-shaped or U-shaped cross-section, and comprises a bottom, opposing sides integrally formed with said bottom, and respective flanges integrally formed with said sides.

8. A structural member according to claim 7, wherein each of said flanges includes a longitudinal fastener groove for receiving fasteners.

9. A structural member according to claim 3, wherein said anchoring means comprises cooperating top and bottom anchor plates attached to each end of said beam, and engaging opposing major surfaces of said flat steel strap to frictionally hold said strap in tension without penetrating said strap from one major surface to the other.

10. A structural member according to claim 9, wherein said anchor plates comprise a series of mating, spaced-apart, lateral crimps.

11. A structural member according to claim 10, wherein the depth of the crimps formed in said anchor plates increases from an inside edge of the plates to an outside edge of the plates.

12. A structural member according to claim 10, wherein the width of the crimps formed in said anchor plates is no greater than 80% of the width of the strap.

13. A structural member according to claim 9, wherein said anchor plates are attached to said beam by a plurality of fasteners extending through the beam and plates, and adjacent to opposing side edges of strap.

14. A structural member according to claim 9, wherein said anchor plates extend at an angle from the top of said beam towards the bottom of said beam to define a sloping bed for holding said strap.

15. A structural member according to claim 3, wherein said beam comprises a steel C-channel including a vertical web member and spaced-apart top and bottom flange members integrally formed with said web member.

16. A structural member according to claim 15, and comprising top and bottom support panels attached to respective top and bottom flange members of said C-channel.

17. A structural member according to claim 16, wherein said flange members include respective integrally-formed hooks adapted for mating with complementary hooks formed with respective top and bottom support panels for connecting said support panels and said beam together.

18. A method of forming a load-bearing structural member, comprising the steps of:

(a) anchoring one end of a strength-reinforcing flat steel strap to one end of a beam;

(b) pulling an opposing end of said strap towards an opposing end of said beam to tension said strap; and (c) anchoring said strap to the opposing ends of said beam at a top of said beam, and applying a downward vertical force to said strap at a point intermediate of said opposing ends, and holding said strap to said beam at the intermediate point adjacent a bottom of said beam, thereby creating an increased supporting reaction force between the ends of said beam at the intermediate point.

19. A method according to claim 18, and comprising marking the tension force applied to said strap on a surface of said beam.

* * * * *

UNITED STATES PATENT AND TRADEMARK OFFICE

CERTIFICATE OF CORRECTION

PATENT NO. : 6,112,484
DATED : September 5, 2000
INVENTOR(S) : Brasington

It is certified that error appears in the above-identified patent and that said Letters Patent is hereby corrected as shown below:

The title page, showing the illustrative figure should be deleted, and substitute therefore the new title page with the illustrated figure attached The drawing sheets consisting of figures 1-11 should be deleted, to be replaced with the drawing sheets consisting of figures 1-11, as shown on the attached sheets.

Signed and Sealed this

First Day of April, 2003

JAMES E. ROGAN
*Director of the United States Patent and Trademark Office*

United States Patent [19]

Brasington

[11] Patent Number: 6,112,484

[45] Date of Patent: Sep. 5, 2000

[54] STRUCTURAL MEMBER WITH STRENGTH-REINFORCING STEEL STRAP

[76] Inventor: Millard A. Brasington, 182 Freeze Crossing Dr., Mooresville, N.C. 28115

[21] Appl. No.: 09/173,877

[22] Filed: Oct. 16, 1998

[51] Int. Cl.[7] ..... E04C 2/34; E04C 3/10; B21D 47/01

[52] U.S. Cl. ..... 52/223.6; 52/223.12; 29/897.32; 29/897.35

[58] Field of Search ..... 52/223.6, 223.8, 52/223.12, 650.3, 654.1, 647; 29/897.312, 897.3, 897.31, 897.32, 897.35

[56] References Cited

U.S. PATENT DOCUMENTS

| | | | |
|---|---|---|---|
| 1,770,932 | 7/1930 | Leake | 52/223.12 |
| 2,039,398 | 5/1936 | Dye | 52/223.12 |
| 2,510,958 | 6/1950 | Coff . | |
| 2,822,068 | 2/1958 | Hendrix . | |
| 3,294,608 | 12/1966 | Peterson | 52/223.8 |
| 3,398,498 | 8/1968 | Krauss . | |
| 3,427,773 | 2/1969 | Kandall . | |
| 4,006,523 | 2/1977 | Mauquoy . | |
| 4,015,376 | 4/1977 | Gerhardt . | |
| 4,236,362 | 12/1980 | Omholt . | |
| 4,275,537 | 6/1981 | Pinson . | |
| 4,353,190 | 10/1982 | Gleeson . | |
| 4,409,764 | 10/1983 | Wilnau . | |
| 4,561,227 | 12/1985 | Austin . | |
| 4,607,470 | 8/1986 | Ecker . | |
| 4,704,830 | 11/1987 | Magadini . | |
| 5,048,257 | 9/1991 | Luedtke . | |
| 5,134,821 | 8/1992 | Sadahiro . | |
| 5,467,570 | 11/1995 | Leek . | |

*Primary Examiner*—Michael Safavi

*Attorney, Agent, or Firm*—Adams, Schwartz & Evans, P.A.

[57] ABSTRACT

A load-bearing structural member includes an elongate beam and a strength-reinforcing flat steel strap. The beam has a top and a bottom, and first and second opposing ends. The steel strap extends along the length of the beam from one end to the other, and is adapted for transferring an intermediate load acting on the beam outwardly to the opposing ends of the beam. Anchor plates located at respective opposing ends of the beam engage and hold the strap in tension.

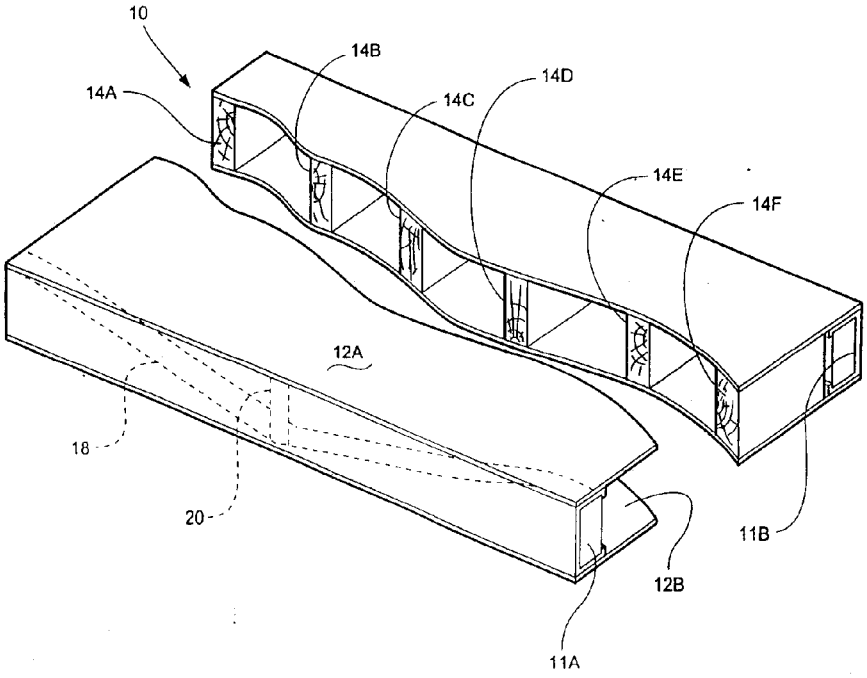

19 Claims, 11 Drawing Sheets